United States Patent [19]

Mann

[11] 4,268,896

[45] May 19, 1981

[54] LAMPSHADE MEANS

[76] Inventor: Ray R. Mann, 3447 Georgetown Rd., Indianapolis, Ind. 46224

[21] Appl. No.: 123,298

[22] Filed: Feb. 21, 1980

[51] Int. Cl.[3] ..... F21V 1/02

[52] U.S. Cl. ..... 362/311; 362/360; 362/361; 40/544

[58] Field of Search ..... 362/311, 351, 352, 353, 362/354, 355, 356, 357, 358, 359, 360, 361; 40/554, 557, 558, 480

[56] References Cited

U.S. PATENT DOCUMENTS

| | | | |
|---|---|---|---|
| 580,707 | 4/1897 | O'Meara | 40/554 |
| 2,151,333 | 3/1939 | Robin | 40/480 |
| 2,624,141 | 1/1953 | Martin | 362/360 |
| 2,823,477 | 2/1958 | Willard | 40/554 |
| 2,824,216 | 2/1958 | Brennan | 362/311 |
| 2,841,697 | 7/1958 | Smith | 362/356 |
| 3,222,517 | 12/1965 | Peter | 40/554 |
| 3,456,106 | 7/1969 | Gluschkin | 40/554 |

*Primary Examiner*—L. T. Hix
*Assistant Examiner*—Alan Mathews
*Attorney, Agent, or Firm*—Robert A. Spray

[57] ABSTRACT

A novel lampshade concept, in formation and assembly. Support means support a pair of bowed sheets of design panels, achieving an inwardly-illuminated effect for the design, thus providing that many decorative sheet panels, such as are provided for place mats or wall pictures, may be conveniently used as lamp shade components with no assembly task except merely inserting them into support grooves, with no glue or other fastening means whatever being required.

9 Claims, 14 Drawing Figures

LAMPSHADE MEANS

The present invention relates to a novel lampshade means.

The inventive concepts provide a novel supporting structure for the shade components, by which flat sheets of flexible sheeting may be easily assembled into a sturdy lampshade, without tools or any fastening means at all.

The concepts further provide a convenient and economical device by which design sheets, such as are already available as for placemats or wall pictures, may be easily assembled into a novel lampshade device, with only substantially zero assembly skill, and without requirement of any tools or fasteners or glue.

Further, the concepts provide a lampshade device which can be easily sold in "k.d." (non-assembled or "knocked-down") condition, providing economy and convenience of packaging and storing, satisfaction of easy assembly by the user, etc.

The concepts also provide a lampshade whose design panels may be easily and conveniently changed as desired by the user, without harm to the panels for re-use as a lampshade or other use, and with dis-assembly and re-assembly convenience and ease as mentioned above.

It is of course not asserted that lampshades having illuminated display or design panels are new as such. Rather, the present invention provides advantageous novelty of concept for achieving a supportive mounting for design panels, which can be easily assembled and interchanged, all conveniently for a "snap-in" type of assembly, and without tools.

Illustrating the prior art as to design-panel lampshades, and correspondingly emphasizing the inventive newness for the present invention, representative prior art is now pointed out.

U.S. Pat. No. 580,707, of 1897 (O'Meara), is an illuminated advertising device formed of a single panel strip; but it expressly requires gum, cement, or securing means such as a paper-fastener, and supported by a circumferentially-extending shoulder of the lower portion of the globe.

U.S. Pat. No. 2,823,477 (Willard) has a multiplicity of window openings; but the support of the picture is circumferential by upwardly and downwardly facing channels which extend circumferentially, those being supported by other structures of the lampshade.

U.S. Pat. No. 3,222,517 (Peter) also has a plurality of windows through which the light source will shine to interiorly illuminate the shade material. However, the frames inherently include frame components for each piece of shade material; and interconnection means for the several panels are for the panel frames rather than the shade material. The height of the lampshade structure on the lamp structure is noted to be regulatable, although there is no indication of a desire to support the shade material in a vertically-centered position with respect to the light source. There is no concept of illuminatable flexible panels providing a circumferential portion of the lampshade by support along only the vertical edges, and no suggesion of holding grooves for the panels.

U.S. Pat. No. 3,456,106 (Gluschkin) shows a decorative panels, interiorly illuminated, as a portion of the lampshade, but there appears to be no suggestion of panel-support merely along a vertical edge; and both of the embodiments are shown to be of a double-shade nature, each of the shade units being circumferentially continuous in contrast to bowed panels of the present invention.

Thus although the prior art, from this search, is seen to show interiorly-illuminated lampshade panels, none shows or suggests this invention's key concept of a lampshade formed from resiliently-deformable panels secured or wholly supported by groove means of vertical supports and by the resilient deformation of the bowed panels whose vertical end edges are thereby supportingly gripped by the grooves, nor other cooperating concepts of this invention.

The above description is of introductory form. More particular details, features, and components of embodiments illustrative of the inventive concepts are set forth in the more detailed description which follows, reference being had to the accompanying somewhat diagrammatic and schematic drawings, in which:

FIG. 1 is a pictorial view of an assembled lampshade means mounted on an associated lamp device;

FIGS. 2, 3, and 4, in slightly smaller scale, are top views of the lampshade device of embodiments having various numbers of support arms and vertical support members, for supporting various sizes and numbers of panel means;

FIG. 5 is an elevation view of a unitary support member of another embodiment;

FIGS. 6 and 7 are views of the vertical support members, taken respectively as shown by View-lines 6—6 and 7—7 of FIGS. 8 and 9 but in slightly smaller scale;

FIGS. 8 and 9 are detail cross-sectional views of the support members, taken respectively as shown by View-lines 8—8 and 9—9 of FIGS. 6 and 7.

Figure 1:
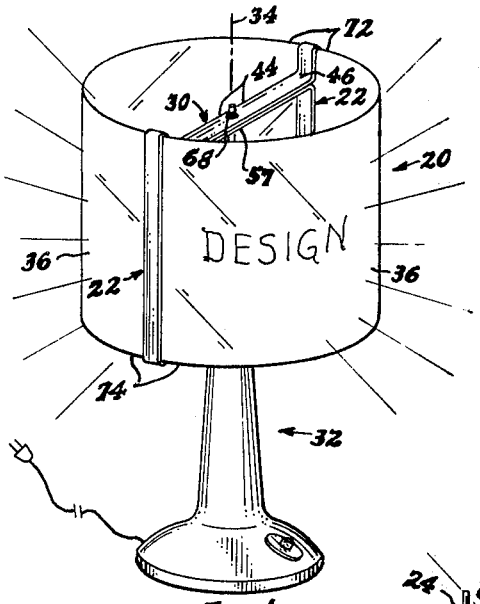

As shown in the drawings, the present invention relates to new and advantageous concepts as to formation of a novel lampshade 20, which provides ease of assembly, interchangeability of panels, and simplicity of construction.

Figure 10:
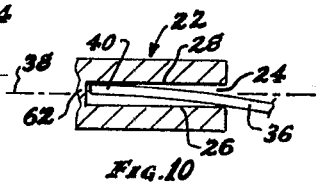
FIG. 10 is an enlarged detail cross-sectional view, similar to FIGS. 8 or 9, illustrating the retention of a panel means by a vertical support member.

More particularly, as shown, the lampshade concepts of this invention provide a pair of generally vertical support members 22; and each of them are provided with a recess groove means 24 providing a pair of opposed vertical abutments 26 and 28 (FIG. 10). The inner abutment 26 faces outwardly, and the outer abutment 28 faces inwardly; and, as shown, they are conveniently formed to be parallel although not necessarily so.

There are provided laterally-extending support means 30 which support the vertical support members 22 from the associated lamp device 32 and spaced from the vertical axis 34 of the lamp device 32.

The generally cylindrical lampshade portion itself is formed of one or more resiliently deformable panel means 36, having whatever design is desired; and such are already available as pictures, place mats, etc. If the design sheet is not sufficiently stiff itself, it may be sandwiched between a couple of carrier sheets. Some translucency and/or transparency of the panels 36 is desirable.

The panels 36 are supported by the vertical support members 22, as now explained, providing ease of assembly and dis-assembly, and with no requirement of extra support except by the supports 22.

The groove means 24 of each support member 22, and its opposed abutments 26 and 28, are provided such that the effective axial plane 38 of the two groove means 24 are non-planar, and are spaced apart, such that opposed edges 40 of the panel means 36 may be inserted into the operatively adjacent groove means 24 of operatively adjacent support members 22 but that in doing so the panel means 36 must be resiliently deformed sufficiently to impart stress thereinto which causes portions of the panel means 36 at or adjacent their opposed edges 40 to press against the opposed abutments 25–28, thereby snugly retaining the assembly of the panel means 36 and the support members 22. (The two grooves 24 which hold any single panel 36 are of course on different supports 22, which are adjacent in that sense.)

In the form shown, in which there are provided at least two of the panel means 36, and each of the support members 22 is provided with groove means 24 opening outwardly in opposite direction; thus any single one of the support members **22*h* as two groove means 24, each of which receives an end portion 40 of a different panel unit 36**.

As shown, the two vertical support members 22 and the laterally-extending support means 30, and the respective groove means 24 of the supports 22 are provided as an integrally-formed unitary structure.

Figure 14:
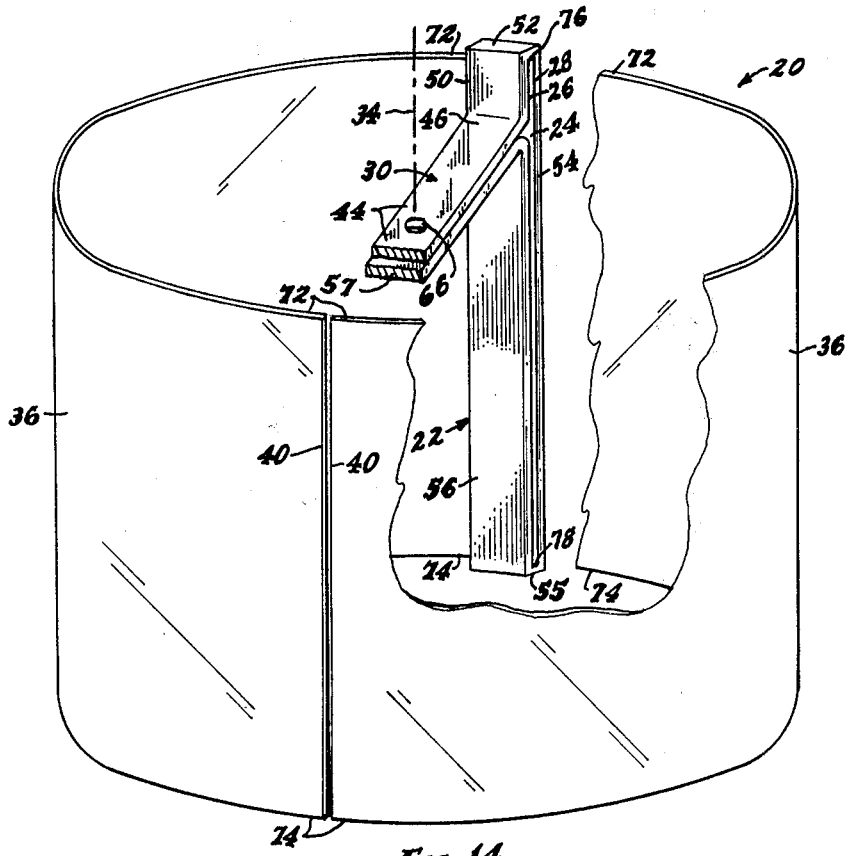
FIG. 14 is an enlarged view of a lampshade in assembled form, the embodiment being that of FIG. 1, but with portions shown as broken away to illustrate details otherwise obscured.

FIGS. 1 and 14 illustrate the concepts by which the integrally-formed unitary structure of those components (22, 24 and 30) is provided by a strip which is formed to provide an intermediate horizontal span portion 44 which provides the laterally extending support means 30 which is supported by the associated lamp device 32; and outwardly of and at each end 46 of the horizontal span portion 44 the strip is formed to provide one of the vertical support members 22 by being formed to provide a vertical portion 50 and a reverse bend 52 and another vertical portion 54, the two vertical portions being spaced one from the other to provide the groove means 24 already mentioned.

The vertical portion 54, at its lower end, is provided with a reverse bend 55 and then another vertical portion 56, the portions 50 and 56 being generally co-planar and spaced from the vertical portion 54 by the groove 24.

Further sturdiness is shown as provided by the fact that the strip (which forms supports 22, grooves 24, and lateral support 30) is formed to integrally also provide a second horizontal span portion 57 which underlies the horizontal portion 44.

Figure 11:
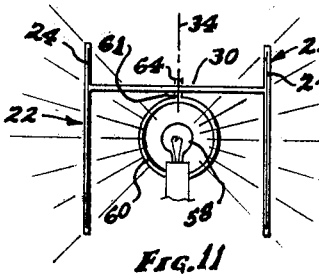
FIG. 11 is a schematic view to illustrate the desired vertical centering of the panels with respect to the light source, achieving a desired vertically-centered design-illumination effect.

A centered design-illumination (FIG. 11) is provided as follows: The formation of the intermediate horizontal span portion 30 and the vertical support members 22 is such that the groove means 24 is vertically spaced with respect to the horizontal span portion 30 such that the groove means 24 extends significantly above the elevation of the horizontal span portion 30, this being such an extending amount that the vertical location of the panel means 36 will be approximately centered with respect to the elevation of the light source 58 of the associated lamp device 32 when the horizontal span portion 30 of the lampshade 20 is mounted upon the shade-support component 60 of the lamp device 32 whose upper support 61 is located less than one-half the height of the panel means 36 above the light source 58 of the associated lamp device 32.

Figures 8, 9:
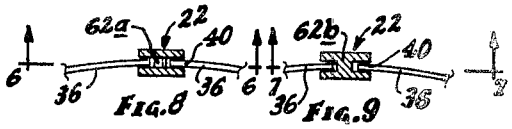
Figure 6:
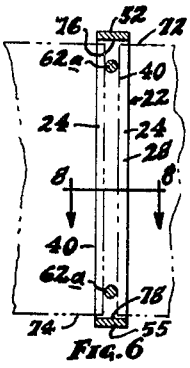
Figure 7:
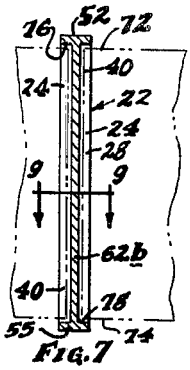

Locating the panels 36 circumferentially with respect to the vertical support members 22, abutment means 62 are provided to provide a bottom for the groove means 24 which limits the depth thereinto into which the end edge 40 of panel means 36 may be inserted. The abutments 62 are shown in FIGS. 6 and 8 as protrusions **62*a* extending from the faces 26 or 28, and in FIGS. 7 and 9 as a vertical strip 62*b*** extending vertically between those faces.

Figure 2:
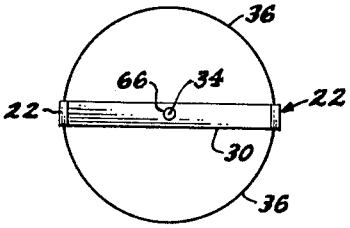
Figure 3:
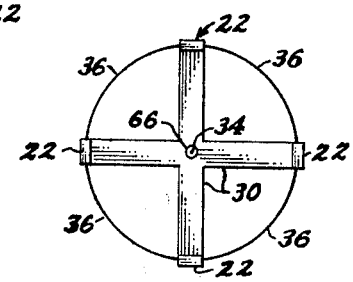
Figure 4:
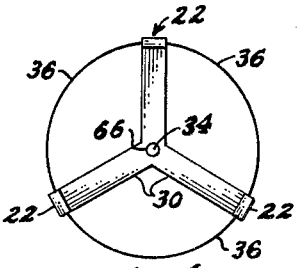

Depending on the size of panels 36 and of the lampshade, there may be provided more than two of the vertical support members 22 and panel means 36; and FIGS. 2 through 4 illustratively show two, three, and four sets thereof.

As is conventional, the lampshade's horizontal support 30 is supported on the lamps support component 61 of ring 60 by a threaded shaft 64 extending upwardly from the lamp's support 60, through a hole 66 in horizontal member 60; and a retainer nut 68 maintains the assembled nature.

Figure 5:
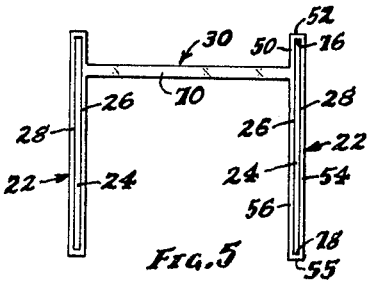
Figures 12, 13:
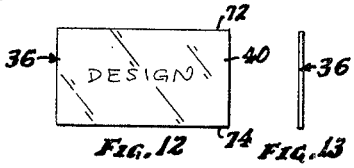
FIGS. 12 and 13 are reduced-scale views, elevational and end, of the design panel when in flat or unstressed condition prior to assembly in lampshade form.

Another form of the suport structure is shown FIG. 5, in which the horizontal support 30 is formed from a single horizontal component 70 rather than the two strips 44 and 57 of FIG. 1. This structure, except for its central hole (like 66 of FIG. 14) and abutments such as **62*a* (of FIG. 6**), could be molded or extruded; and possibly it could be molded even without those exceptions.

The panels 36 as shown are of a height such that their upper and lower edges 72–74 just snugly fit between the upper and lower limits of the grooves 24, shown as provided by the inwardly-facing walls 76–78, respectively of the reverse or turnover ends 52 and 55 of the support members 22. This of course helps in the retention effect, without fasteners, glue, etc.

It is thus seen that a lampshade according to the inventive concepts provides a desired and advantageous device, yielding the high appeal of a "do-it-yourself" project from a kit whose components require no assembly tools and no necessary modification by the user, which can be modified as desired with replacement panels, and which provides an attractive object having not only good attractiveness and utility but providing also a "conversation piece" decorative effect. Replacement panels may be easily made from commercially-available pictures, place-mat, etc.; and if the panel is not sufficiently rigid, blank facing panels may be formed from plastic sheets. Much ingenuity and decorative artistry and ability may also be used, to enhance the desired effects; and various objects, collections, and designs may be displayed interestingly by use of supplementary blank or outline-type panels.

Accordingly, it will thus be seen from the foregoing description of the invention according to this illustrative embodiment, considered with the accompanying drawings, that the present invention provides new and useful concepts of a lampshade which is easily assembled from a kit form, and with ease of modification and interchangeability, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

For example, the words "vertical" and "horizontal" herein have been used as if the light device were a conventional table or floor lamp, with a vertical axis, and with the panel sheets to provide a lampshade of precisely cylindrical shape. Obviously, the inventive concepts would be the same if the lamp-axis were inclined to the vertical; so although the terms "vertical" and "horizontal" are used herein, the inventive concepts are not to be interpreted strictly as limited in that exact manner, in the description or claims. Similarly, although the effective axial plane of the grooves is shown in FIGS. 8–10 as tangent to a cylindrical shape of a wall formed by the bowed panels, that tangency and even the precise cylindrical shape are not necessary so to be within the inventive concepts.

What is claimed is:

1. A lampshade, comprising, in combination:

a pair of generally vertical support members, each provided with a recess groove means providing a pair of opposed abutments;

laterally-extending support means supporting the said vertical support members from the associated lamp device and spaced from the vertical axis of the lamp device;

a resiliently deformable panel means;

the groove means of each support member, and its opposed abutments, being provided such that the effective axial plane of the two groove means are non-planar, and are spaced apart, such that opposed edges of the panel means may be inserted into the operatively adjacent groove means of operatively adjacent support members but that in doing so the panel means must be resiliently deformed sufficiently to impart stress thereinto which causes portions of the panel means at or adjacent said opposed edges to press against the opposed abutments, thereby snugly retaining the assembly of the panel means and the support members;

in a combination in which there are provided at least two of the said panel means, and each of the support members is provided with groove means opening outwardly in opposite directions.

2. The invention as set forth in claim 1 in a combination in which the two vertical support members and the laterally-extending support means and their respective groove means are provided as an integrally-formed unitary structure.

3. The invention as set forth in claim 2 in a combination in which the integrally-formed unitary structure is provided by a strip which is formed to provide an intermediate horizontal span portion which provides the laterally extending support means which is supported by the associated lamp device, and outwardly of and at each end of the horizontal span portion the strip is formed to provide one of the vertical support members by being formed to provide a vertical portion and a reverse bend and another vertical portion, the two vertical portions being spaced one from the other to provide the upper portion of the groove means; and the last-identified vertical portion, at its lower ends, is provided with a reverse bend and then another vertical portion, that vertical portion and the one designated above as the "last-identified" vertical portion being generally co-planar and spaced from the other vertical portion to provide the lower portion of the groove means.

4. The invention as set forth in claim 3 in a combination in which the strip integrally also is formed to provide a second horizontal span portion giving further sturdiness.

5. The invention as set forth in claim 3 in a combination in which the formation of the intermediate horizontal span portion and the vertical support members is such that the groove means is vertically spaced with respect to the horizontal span portion such that the groove means extends significantly above the elevation of the horizontal span portion, such that the vertical location of the panel means will be approximately centered with respect to the elevation of the light source of the associated lamp device when the horizontal span portion is mounted upon the shade-support component of the lamp device which is located less than one-half the height of the panel means above the light source of the associated lamp device.

6. The invention as set forth in claim 3 in a combination in which abutment means are provided to provide a bottom for the groove means which limits the depth thereinto into which the panel means may be inserted.

7. The invention as set forth in claim 1 in a combination in which there are provided a plurality, more than two, of the vertical support members and panel means.

8. The invention as set forth in claim 1 in a combination in which the formation of the laterally-extending support means and the vertical support members is such that the groove means is vertically spaced with respect to the laterally-extending support means such that the groove means extends significantly above the elevation of the laterally-extending support means, such that the vertical location of the panel means will be approximately centered with respect to the elevation of the light source of the associated lamp device when the laterally-extending support means is mounted upon the shade-support component of the lamp device which is located less than one-half the height of the panel means above the light source of the associated lamp device.

9. The invention as set forth in claims 5 or 8 in a combination in which the panel means is provided of operatively translucent or transparent stock, the panel means thus achieving an inwardly-illuminated effect as to a design provided on the panel means.

* * * * *

UNITED STATES PATENT AND TRADEMARK OFFICE

CERTIFICATE OF CORRECTION

PATENT NO. : 4,268,896

DATED : May 19, 1981

INVENTOR(S) : Ray Mann

It is certified that error appears in the above—identified patent and that said Letters Patent is hereby corrected as shown below:

Col. 3, line 19: The number "25" should be: -- 26 --.

Col. 4, line 26: The word "suport" should be" -- support --.

Col. 4, line 50: The word "place-mat" should be:
-- place-mats --.

Signed and Sealed this

*Nineteenth* Day of *October 1982*

[SEAL]

*Attest:*

GERALD J. MOSSINGHOFF

*Attesting Officer*

*Commissioner of Patents and Trademarks*